US010190824B2

(12) United States Patent
Hugg et al.

(10) Patent No.: US 10,190,824 B2
(45) Date of Patent: Jan. 29, 2019

(54) TAPHOLE ASSEMBLY, METHOD FOR MANUFACTURING A TAPHOLE ASSEMBLY, AND METALLURGICAL FURNACE

(71) Applicant: OUTOTEC (FINLAND) OY, Espoo (FI)

(72) Inventors: Eero Hugg, Espoo (FI); Kari Pienimäki, Espoo (FI); Mika Ketola, Espoo (FI); Mikael Jåfs, Espoo (FI)

(73) Assignee: Outotec (Finland) Oy, Espoo (FI)

( * ) Notice: Subject to any disclaimer, the term of this patent is extended or adjusted under 35 U.S.C. 154(b) by 118 days.

(21) Appl. No.: 14/400,771

(22) PCT Filed: May 27, 2013

(86) PCT No.: PCT/FI2013/050579
§ 371 (c)(1),
(2) Date: Nov. 12, 2014

(87) PCT Pub. No.: WO2013/178878
PCT Pub. Date: Dec. 5, 2013

(65) Prior Publication Data

US 2015/0176903 A1 Jun. 25, 2015

(30) Foreign Application Priority Data

May 28, 2012 (CN) ..... 2012 2 0242897 U

(51) Int. Cl.
*F27D 3/15* (2006.01)
*F27D 99/00* (2010.01)
*F27D 3/14* (2006.01)

(52) U.S. Cl.
CPC ..... *F27D 3/1518* (2013.01); *F27D 3/14* (2013.01); *F27D 99/00* (2013.01); *Y10T 29/49826* (2015.01)

(58) Field of Classification Search
CPC ..... F27D 3/14; F27D 3/1518; F27D 3/1527; F27D 99/00; Y10T 29/49826
(Continued)

(56) References Cited

U.S. PATENT DOCUMENTS 3,554,523 A 1/1971 Miller
4,328,956 A 5/1982 Lalama et al.
(Continued)

FOREIGN PATENT DOCUMENTS

FR 2019856 * 7/1970
FR 2019856 A1 7/1970
(Continued)

OTHER PUBLICATIONS

International Search Report for PCT/FI2013/050579, dated Aug. 27, 2013, 3 pgs.
(Continued)

*Primary Examiner* — Scott R Kastler
*Assistant Examiner* — Michael Aboagye
(74) *Attorney, Agent, or Firm* — Chernoff Vilhauer LLP

(57) ABSTRACT

A taphole assembly (1) for arranging in a taphole assembly opening (2) extending through a shell (3) and a refractory lining (4) of a metallurgical furnace (5) such as a pyrometallurgical furnace and for leading melt from the inside of the metallurgical furnace (5) to the outside of the metallurgical furnace (5). The taphole assembly comprises: a frame section of metal (6) to be arranged in a taphole assembly opening (2) extending through a shell (3) and a refractory lining (4) of a of a metallurgical furnace (5), at least one refractory insert channel element (7) arranged in a seat (8) of the frame section of metal (6) and having a channel (9) for melt. The invention relates also to a method for manufacturing a taphole assembly and to a metallurgical furnace including a taphole assembly.

20 Claims, 4 Drawing Sheets

(58) Field of Classification Search
USPC ..... 266/45, 236, 241, 283, 281; 222/592
See application file for complete search history.

(56) References Cited

U.S. PATENT DOCUMENTS

| | | | | |
|---|---|---|---|---|
| 4,708,327 | A | 11/1987 | Waltenspuhl | |
| 4,984,769 | A * | 1/1991 | Bruckner | C21C 5/445 222/604 |
| 5,916,471 | A | 6/1999 | Hall | |
| 7,510,679 | B2 * | 3/2009 | Motomura | C22B 15/0047 266/236 |
| 7,850,903 | B2 * | 12/2010 | Kummer | F27B 3/19 266/241 |
| 8,038,930 | B2 * | 10/2011 | Seppala | B22D 19/0072 148/519 |
| 2008/0272525 | A1 | 11/2008 | Seppala et al. | |

FOREIGN PATENT DOCUMENTS

| | | | |
|---|---|---|---|
| GB | 1255074 | A | 11/1971 |
| JP | 2008-138906 | A | 6/2008 |
| WO | WO0049185 | A1 | 8/2000 |

OTHER PUBLICATIONS

Extended European Search Report prepared by the European Patent Office for EP 13797552, dated Feb. 16, 2016, 8 pages.
Notice of Grounds for Rejection prepared by the Korean Intellectual Property Office for KR 2014-7036072, dated Jun. 17, 2016, 5 pages.
Office Action prepared by the Chilean Patent Office for CL 201403214, dated Jun. 21, 2017, 9 pages.

* cited by examiner

TAPHOLE ASSEMBLY, METHOD FOR MANUFACTURING A TAPHOLE ASSEMBLY, AND METALLURGICAL FURNACE

CROSS-REFERENCE TO RELATED APPLICATIONS

This is a national stage application filed under 35 USC 371 based on International Application No. PCT/FI2013/050579 filed May 27, 2013 and claims priority under 35 USC 119 of Chinese Patent Application No. 201220242897.5 filed May 28, 2012.

STATEMENT REGARDING FEDERALLY SPONSORED RESEARCH OR DEVELOPMENT

Not Applicable.

THE NAMES OF THE PARTIES TO A JOINT RESEARCH AGREEMENT Not Applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB) Not Applicable.

STATEMENT REGARDING PRIOR DISCLOSURES BY THE INVENTOR OR A JOINT INVENTOR. Not Applicable.

FIELD OF THE INVENTION

The invention relates to a taphole assembly for arranging in a taphole assembly opening extending through a shell and a refractory lining of a metallurgical furnace such as a pyrometallurgical furnace and for leading melt from the inside of the metallurgical furnace to the outside of the metallurgical furnace.

The invention also relates to a metallurgical furnace such as a pyrometallurgical furnace, wherein the metallurgical furnace comprises a shell and a refractory lining, a taphole assembly opening extending through the shell and the refractory lining of a metallurgical furnace, a taphole assembly for leading melt from the inside of the metallurgical furnace to the outside of the metallurgical furnace arranged in the taphole assembly opening The invention relates also to a method for manufacturing a taphole assembly for arranging in a taphole assembly opening extending through a shell and a refractory lining of a metallurgical furnace such as of a pyrometallurgical furnace and for leading melt from the inside of the metallurgical furnace to the outside of the metallurgical furnace.

BACKGROUND OF THE INVENTION

Publication U.S. Pat. No. 3,554,423 presents a taphole assembly for a metallurgical furnace.

OBJECTIVE OF THE INVENTION

The object of the invention is to provide an improved taphole assembly, an improved method for manufacturing a taphole assembly, and a metallurgical furnace having an improved taphole assembly.

BRIEF SUMMARY OF THE INVENTION

The taphole assembly for arranging in a taphole assembly opening extending through a shell and a refractory lining of a metallurgical furnace comprises a frame section of metal. The taphole assembly comprises additionally at least one refractory insert channel element arranged in a seat of the frame section of metal and having a channel for melt.

In a preferred embodiment of the taphole assembly the frame section of metal comprises at least two identical frame parts of metal. In this preferred embodiment said at least two identical frame parts of metal are connected such that a connection face between said at least two identical frame parts of metal cuts the seat for the refractory insert channel element such that an identical longitudinal groove is formed in each of said at least two identical frame parts of metal. Because the frame section of metal of the taphole assembly comprises in this preferred embodiment at least two identical frame parts of metal, the need for spare parts is reduced, because one spare part can be used in several positions in the taphole assembly. This also enables to change the position of the identical frame parts of metal in the taphole assembly.

The metallurgical furnace comprises a shell and a refractory lining. The metallurgical furnace comprises additionally a taphole assembly opening extending through the shell and the refractory lining of a metallurgical furnace. The metallurgical furnace comprises additionally a taphole assembly for leading melt from the inside of the metallurgical furnace to the outside of the metallurgical furnace arranged in the taphole assembly opening. The taphole assembly comprises a frame section of metal and at least one refractory insert channel element arranged in a seat of the frame section of metal and having a channel for melt.

In a preferred embodiment of the metallurgical furnace the frame section of metal of the taphole assembly comprises at least two identical frame parts of metal. In this preferred embodiment said at least two identical frame parts of metal are connected such that a connection face between said at least two identical frame parts of metal cuts the seat for the refractory insert channel element such that an identical longitudinal groove is formed in each of said at least two identical frame parts of metal. Because the frame section of metal of the taphole assembly comprises in this preferred embodiment at least two identical frame parts of metal, the need for spare parts is reduced, because one spare part can be used in several positions in the taphole assembly. This also enables to change the position of the identical frame parts of metal in the taphole assembly.

BRIEF DESCRIPTION OF THE SEVERAL VIEWS OF THE DRAWINGS

In the following the invention will described in more detail by referring to the figures, which

DETAILED DESCRIPTION OF THE INVENTION

Figure 1:
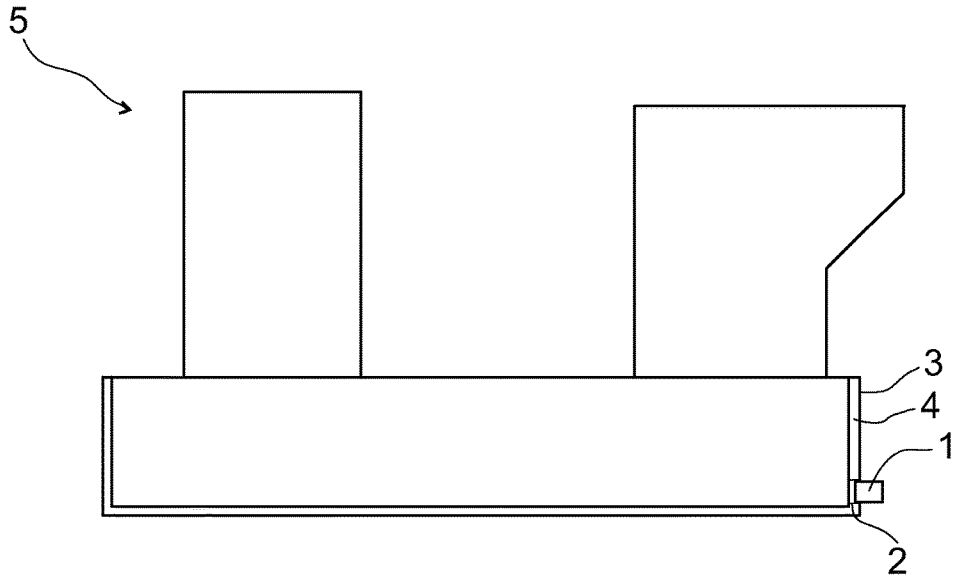
FIG. 1 is a principle drawing showing a metallurgical furnace in the form of a pyrometallurgical having a taphole assembly arranged in a taphole assembly opening extending through a shell and a refractory lining of the metallurgical furnace.
Figure 2:
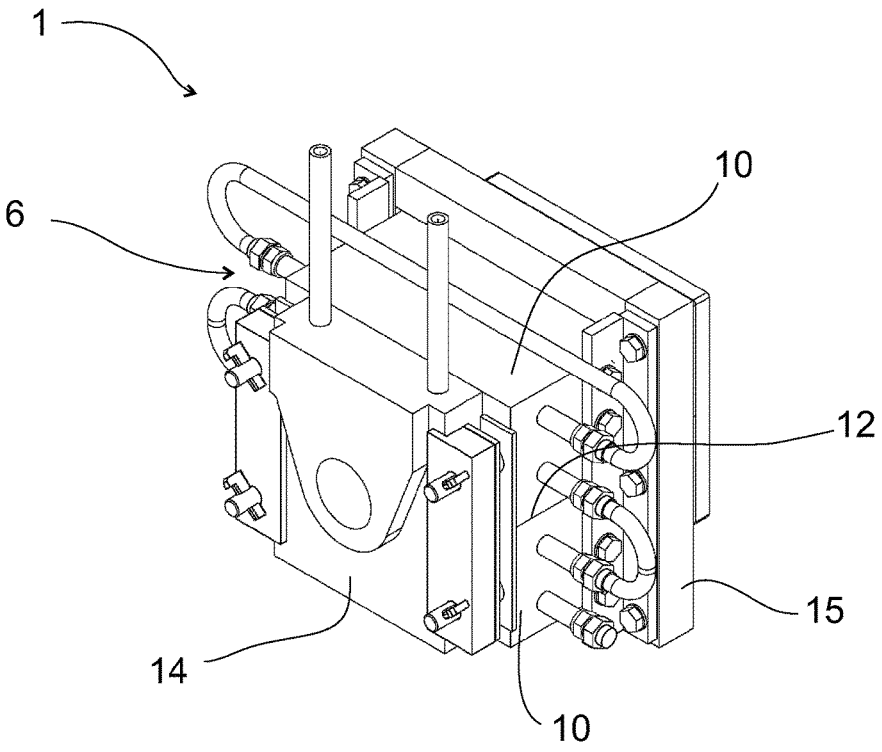
FIG. 2 shows a taphole assembly according to one embodiment.
Figure 3:
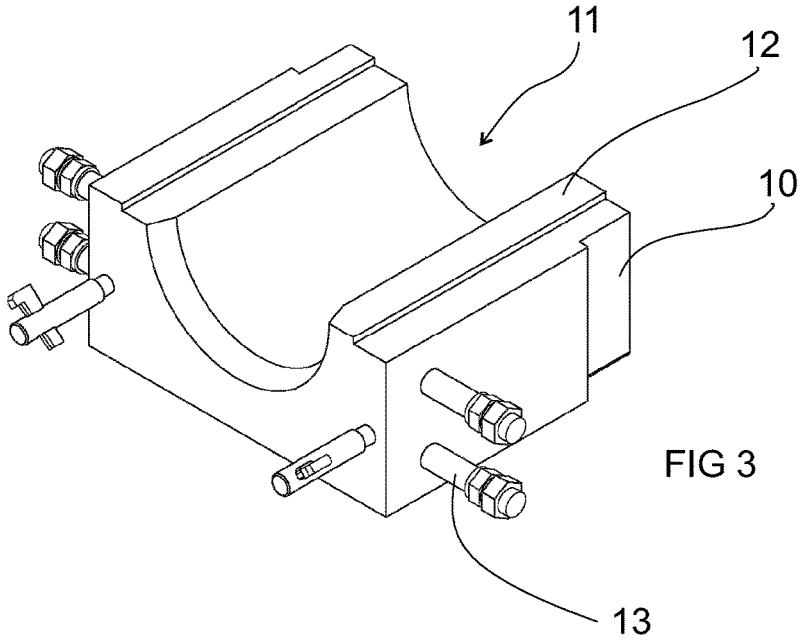
FIG. 3 shows a frame part used in the taphole assembly shown in FIG. 2.
Figure 4:
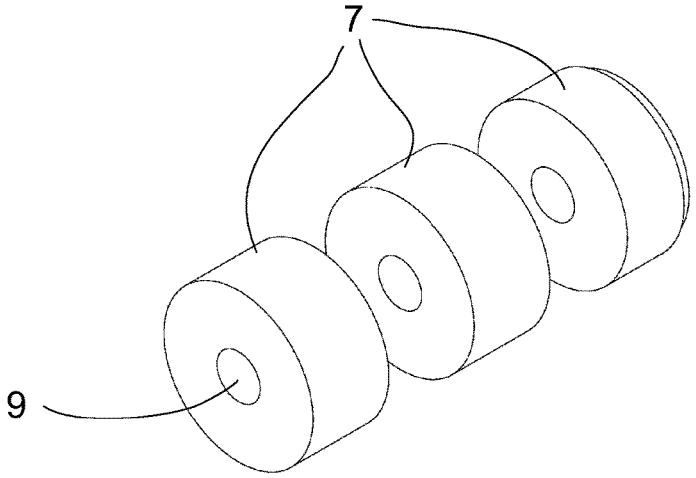
FIG. 4 shows a refractory insert channel element used in the taphole assembly shown in FIG. 2.
Figure 5:
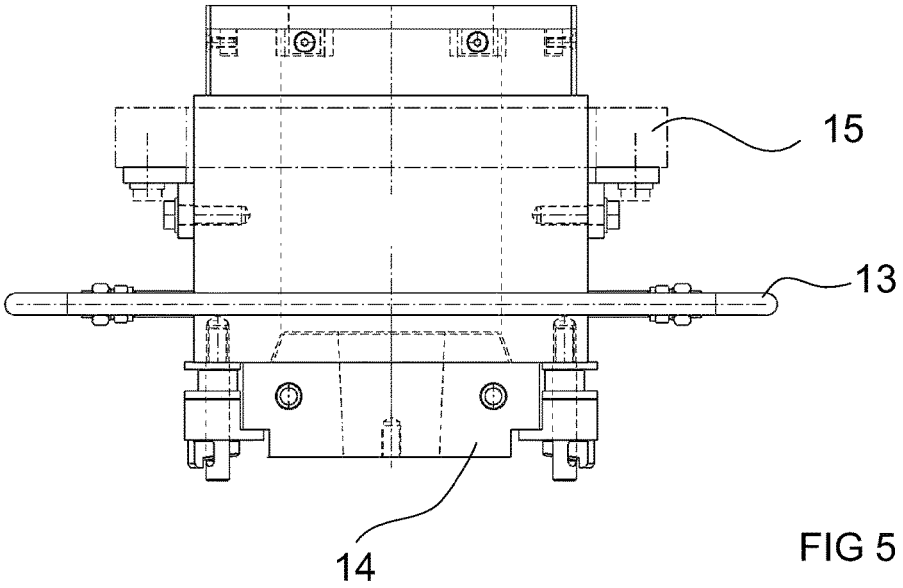
FIG. 5 shows the taphole assembly shown in FIG. 2 as seen from above.
Figure 6:
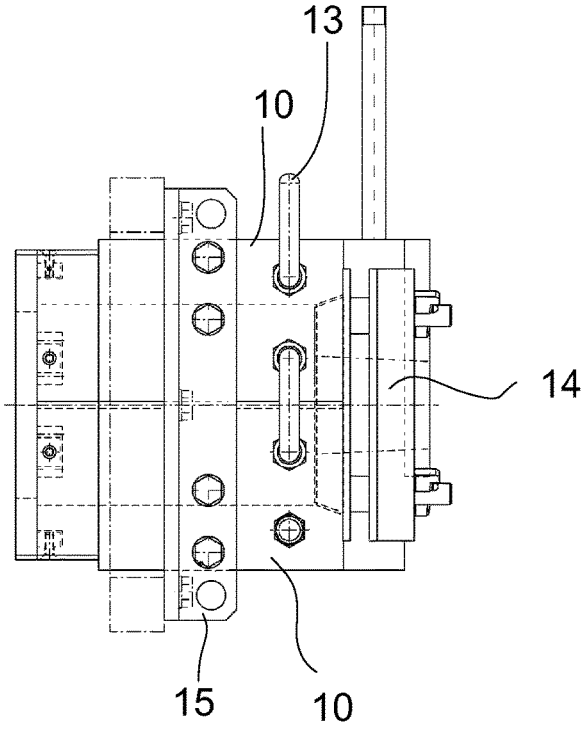
FIG. 6 shows the taphole assembly shown in FIG. 2 as seen from one side
Figure 7:
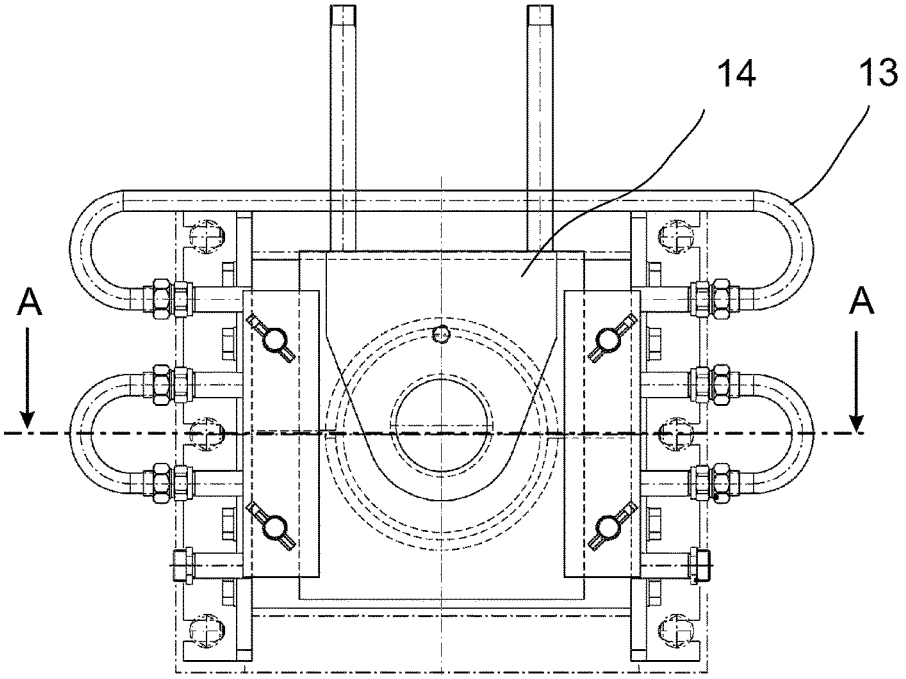
FIG. 7 shows the taphole assembly shown in FIG. 2 as seen from the end that is to be in communication with the interior of a furnace.
Figure 8:
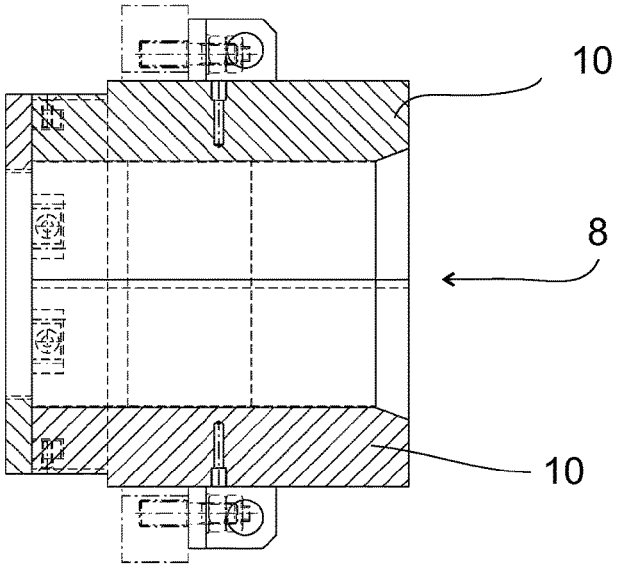
FIG. 8 shows the taphole assembly shown in FIG. 2 as cut along line A-A in FIG. 7.

The invention relates to a taphole assembly 1 for arranging in a taphole assembly opening 2 extending through a shell 3 and a refractory lining 4 of a metallurgical furnace 5 such as a pyrometallurgical furnace and for leading melt from the inside of the metallurgical furnace 5 to the outside of the metallurgical furnace 5.

The invention relates also to a metallurgical furnace 5 such as of a pyrometallurgical furnace comprising a shell 3 and a refractory lining 4 and a taphole assembly opening 2 extending through the shell 3 and the refractory lining 4 of the metallurgical furnace 5 and having a taphole assembly 1 in the taphole assembly opening 2.

The invention relates also to a method manufacturing a taphole assembly for arranging in a taphole assembly opening 2 extending through a shell 3 and a refractory lining (4) of a metallurgical furnace 5 such as of a pyrometallurgical furnace and for leading melt from the inside of the metallurgical furnace 5 to the outside of the metallurgical furnace 5.

FIG. 1 shows a metallurgical furnace 5 in the form of a pyrometallurgical furnace, more precisely in the form of a suspension smelting furnace. The metallurgical furnace 5 shown in FIG. 1 has a taphole assembly 1 arranged in a taphole assembly opening 2 extending through a shell 3 and a refractory lining 4 of the metallurgical furnace 5.

The taphole assembly opening 2 extending through the shell 3 and the refractory lining 4 of the metallurgical furnace 5 can for example be cuboid-shaped or be cylindrical.

First the taphole assembly 1 for arranging in a taphole assembly opening 2 extending through a shell 3 and a refractory lining 4 of a metallurgical furnace 5 such as a pyrometallurgical furnace and for leading melt from the inside of the metallurgical furnace 5 to the outside of the metallurgical furnace 5 and preferred embodiments and variants of the taphole assembly 1 will be described in greater detail.

The taphole assembly 1 comprises a frame section of metal 6 to be arranged in a taphole assembly opening 2 extending through a shell 3 and a refractory lining 4 of the metallurgical furnace 5. The taphole assembly 1 may be configured to be arranged in a taphole assembly opening 2 so that the taphole assembly 1 extends from the outside of the metallurgical furnace 5 in the taphole assembly opening 2 only through the shell 3 of the metallurgical furnace 5 and not in the taphole assembly opening 2 to the refractory lining 4. Alternatively, the taphole assembly 1 may be configured to be arranged in a taphole assembly opening 2 so that the taphole assembly 1 extends from the outside of the metallurgical furnace 5 in the taphole assembly opening 2 through the shell 3 of the metallurgical furnace 5 and at least partly through the refractory lining 4.

The taphole assembly 1 comprises at least one refractory insert channel element 7 arranged in a seat 8 for said at least one refractory insert channel element 7 in the frame section of metal 6 and having a channel 9 for melt.

The frame section of metal 6 comprises preferably, but not necessarily, at least two identical frame parts of metal 10. Said at least two identical frame parts of metal 10 are connected such that a connection face 12 between said at least two identical frame parts of metal 10 cuts the seat 8 for said at least one refractory insert channel element 7 such that an identical longitudinal groove 11 is formed in each of said at least two identical frame parts of metal 10.

The taphole assembly 1 comprises preferably, but not necessarily, cooling channels 13 for circulation of a cooling medium in the frame section of metal 6. In the taphole assembly 1 shown in the figures, the cooling channels 13 comprise both cooling channels 13 formed inside said at least two identical frame parts of metal 10 and cooling channels 13 formed by pipes outside said at least two identical frame parts of metal 10.

The frame section of metal 6 may, as in the embodiment shown in FIGS. 2 to 8, comprise two identical frame parts of metal 10 so that each of said two identical frame part of metal comprises an identical longitudinal groove 11 in the form of a straight half-cylindrical groove. In the embodiment shown in FIGS. 2 to 8 the taphole assembly 1 comprises three refractory insert channel elements 7, which are cylindrical and which each have a concentric channel 9 for melt.

The frame section of metal 6 comprises in another embodiment (not shown in the figures) four identical frame parts of metal 10 so that each of said four identical frame parts of metal 10 comprising an identical longitudinal groove 11 in the form of a straight semi-cylindrical groove, more precisely in the form of a quarter-cylindrical groove. In this embodiment the taphole assembly 1 comprises at least one refractory insert channel element 7 that is cylindrical and which each have a concentric channel 9 for melt.

The frame section of metal 6 comprises in another embodiment (not shown in the figures) two identical frame parts of metal 10. In this embodiment each of said to frame part of metal may comprise an identical longitudinal groove 11 in the form of a straight half-cylindrical groove and at least one refractory insert channel element 7 that is cylindrical and that may have a concentric channel 9 for melt. Alternatively each of said to frame part of metal may comprise an identical longitudinal groove 11 in the form of a cuboid-shaped groove and at least one refractory insert channel element 7 that is cuboid-shaped and that may have a cylindrical channel 9 for melt.

The frame section of metal 6 comprises in another embodiment (not shown in the figures) four identical frame parts of metal 10. In this embodiment each of said to frame part of metal may comprise an identical longitudinal groove 11 in the form of a straight half-cylindrical groove and at least one refractory insert channel element 7 that is cylindrical and that may have a concentric channel 9 for melt. Alternatively each of said to frame part of metal may comprise an identical longitudinal groove 11 in the form of a cuboid-shaped groove and at least one refractory insert channel element 7 that is cuboid-shaped and that may have a cylindrical channel 9 for melt.

The taphole assembly 1 may, as shown in the figures, comprise a separate face plate of metal 14 releasable fastened to the identical frame parts of metal 10. The separate face plate of metal 14 may be made of steel.

The taphole assembly 1 may, as shown in the figures, comprise a separate flange element 15 for fastening the taphole assembly to the metallurgical furnace 5, which separate flange element 15 is releasable fastened to said at least two identical frame parts of metal 10, and which separate flange element 15 at least partly surrounding said at least two identical frame parts of metal 10. The separate flange element 15 may be made of metal such as steel.

The frame section of metal 6 is preferable, but not necessarily, at least partly made of copper and/or copper alloy.

Next the metallurgical furnace 5 such as a pyrometallurgical furnace and some preferred embodiments and variants thereof will be described in greater detail.

The metallurgical furnace 5 comprises a shell 3 and a refractory lining 4.

The metallurgical furnace 5 comprises additionally a taphole assembly opening 2 extending through the shell 3 and the refractory lining 4 of a metallurgical furnace 5.

The metallurgical furnace 5 comprises additionally a taphole assembly 1 for leading melt from the inside of the metallurgical furnace 5 to the outside of the metallurgical furnace 5 arranged in the taphole assembly opening 2. The taphole assembly 1 may be arranged in the taphole assembly opening 2 so that the taphole assembly 1 extends from the outside of the metallurgical furnace 5 in the taphole assembly opening 2 only through the shell 3 of the metallurgical furnace 5 and not in the taphole assembly opening 2 to the refractory lining 4. Alternatively, the taphole assembly 1 may be arranged in the taphole assembly opening 2 so that the taphole assembly 1 extends from the outside of the metallurgical furnace 5 in the taphole assembly opening 2 through the shell 3 of the metallurgical furnace 5 and at least partly through the refractory lining 4.

The taphole assembly 1 comprises a frame section of metal 6 and at least one refractory insert channel element 7 arranged in a seat 8 of the frame section of metal 6 and having a channel 9 for melt.

The frame section of metal 6 comprises preferably, but not necessarily, at least two identical frame parts of metal 10. Said at least two identical frame parts of metal 10 are connected such that a connection face 12 between said at least two identical frame parts of metal 10 cuts the seat 8 for the refractory insert channel element 7 such that an identical longitudinal groove 11 is formed in each of said at least two identical frame parts of metal 10.

The taphole assembly 1 comprises preferably, but not necessarily, cooling channels 13 for circulation of a cooling medium in the frame section of metal 6. In the taphole assembly 1 shown in the figures, the cooling channels 13 comprise both cooling channels 13 formed inside said at least two identical frame parts of metal 10 and cooling channels 13 formed by pipes outside said at least two identical frame parts of metal 10.

The frame section of metal 6 may, as in the embodiment shown in FIGS. 2 to 8, comprise two identical frame parts of metal 10 so that each of said two identical frame part of metal comprises an identical longitudinal groove 11 in the form of a straight half-cylindrical groove. In the embodiment shown in FIGS. 2 to 8 the taphole assembly 1 comprises three refractory insert channel elements 7, which are cylindrical and which each have a concentric channel 9 for melt.

The frame section of metal 6 comprises in another embodiment (not shown in the figures) four identical frame parts of metal 10 so that each of said four identical frame parts of metal 10 comprising an identical longitudinal groove 11 in the form of a straight semi-cylindrical groove, more precisely in the form of a quarter-cylindrical groove. In this embodiment the taphole assembly 1 comprises at least one refractory insert channel element 7 that is cylindrical and which each have a concentric channel 9 for melt.

The frame section of metal 6 comprises in another embodiment (not shown in the figures) two identical frame parts of metal 10. In this embodiment each of said to frame part of metal may comprise an identical longitudinal groove 11 in the form of a straight half-cylindrical groove and at least one refractory insert channel element 7 that is cylindrical and that may have a concentric channel 9 for melt. Alternatively each of said to frame part of metal may comprise an identical longitudinal groove 11 in the form of a cuboid-shaped groove and at least one refractory insert channel element 7 that is cuboid-shaped and that may have a cylindrical channel 9 for melt.

The frame section of metal 6 comprises in another embodiment (not shown in the figures) four identical frame parts of metal 10. In this embodiment each of said to frame part of metal may comprise an identical longitudinal groove 11 in the form of a straight half-cylindrical groove and at least one refractory insert channel element 7 that is cylindrical and that may have a concentric channel 9 for melt. Alternatively each of said to frame part of metal may comprise an identical longitudinal groove 11 in the form of a cuboid-shaped groove and at least one refractory insert channel element 7 that is cuboid-shaped and that may have a cylindrical channel 9 for melt.

The taphole assembly 1 may, as shown in the figures, comprise a separate face plate of metal 14 releasable fastened to the identical frame parts of metal 10. The separate face plate of metal 14 may be made of steel.

The taphole assembly 1 may, as shown in the figures, comprise a separate flange element 15 for fastening the taphole assembly to the metallurgical furnace 5, which separate flange element 15 is releasable fastened to said at least two identical frame parts of metal 10, and which separate flange element 15 at least partly surrounding said at least two identical frame parts of metal 10. The separate flange element 15 may be made of metal such as steel.

The frame section of metal 6 is preferable, but not necessarily, at least partly made of copper and/or copper alloy. Next the method for manufacturing a taphole assembly and some preferred embodiments and variants thereof will be described in greater detail.

The method comprises a first providing step for providing a frame section of metal 6 to be arranged in a taphole assembly opening 2 extending through a shell 3 and a refractory lining 4 of a of a metallurgical furnace 5.

The method comprises providing the frame section of metal 6 with a seat 8 for at least one refractory insert channel element 7.

The method comprises a second providing step for providing at least one refractory insert channel element 7 having a channel 9 for melt The method comprises arranging said at least one refractory insert channel element 7 having a channel 9 for melt in the seat 8 of the frame section of metal 6.

The method may comprise providing the taphole assembly with cooling channels 13 for circulation of a cooling medium in the frame section of metal 6.

The method may comprise providing in the first providing step a frame section of metal 6 comprising at least two identical frame parts of metal 10 and providing the frame section of metal 6 with a seat 8 for at least one refractory insert channel element 7 so that said at least two identical frame parts of metal 10 are connectable such that a connection face 12 between said at least two identical frame parts of metal 10 cuts the seat 8 for the refractory insert channel element 7 such that an identical longitudinal groove 11 is formed in each of said at least two identical frame parts of metal 10.

The method may comprise providing in the first providing step a frame section of metal 6 comprising two identical frame parts of metal 10 and providing each frame part of metal 10 i.e. both identical frame parts of metal 10 with an identical longitudinal groove 11 in the form of a straight half-cylindrical groove. In this case the method comprises preferably, but not necessarily, providing in the second providing step at least one refractory insert channel element 7 that cylindrical and that has a concentric channel 9 for melt.

The may comprise providing in the first providing step a frame section of metal 6 comprises four identical frame parts of metal 10 and providing each frame part of metal 10 i.e. all four identical frame parts of metal 10 with a longitudinal groove 11 in the form of a straight semi-cylindrical groove. In this case the method comprises preferably, but not necessarily, providing in the second providing step at least one refractory insert channel element 7 that cylindrical and that has a concentric channel 9 for melt.

The method may comprise a third providing for providing a separate face plate of metal 14 and a step for releasable fastening the separate face plate of metal 14 to said at least two identical frame parts of metal 10.

The method may comprise a fourth providing step for providing a separate flange element 15 for fastening the taphole assembly to a metallurgical furnace 5 and a step for releasable fastening the separate flange element 15 to said at least two identical frame parts of metal 10 so that the separate flange element 15 at least partly surrounds said at least two identical frame parts of metal 10.

The method may comprise providing in the first providing step a frame section of metal 6 that is at least partly made of copper and/or copper alloy.

It is apparent to a person skilled in the art that as technology advanced, the basic idea of the invention can be implemented in various ways. The invention and its embodiments are therefore not restricted to the above examples, but they may vary within the scope of the claims.

The invention claimed is:

1. A method for manufacturing a taphole assembly for arranging in a taphole assembly opening extending through a shell and a refractory lining of a metallurgical furnace such as of a pyrometallurgical furnace and for leading melt from the inside of the metallurgical furnace to the outside of the metallurgical furnace, wherein the method comprises a first providing step for providing a frame section of metal to be arranged in a taphole assembly opening extending through a shell and a refractory lining of a metallurgical furnace, providing the frame section of metal with a seat for at least one refractory insert channel element, a second providing step for providing at least one refractory insert channel element having a channel for melt, arranging said at least one refractory insert channel element having a channel for melt in the seat of the frame section of metal, providing in the first providing step a frame section of metal comprising at least two identical frame parts of metal, and a third providing step for providing a separate face plate of metal, releasable fastening the separate face plate of metal to said at least two identical frame parts of metal at an end face of the taphole assembly, and providing the frame section of metal with a seat for at least one refractory insert channel element so that said at least two identical frame parts of metal are connectable such that a connection face between said at least two identical frame parts of metal forms the seat for the refractory insert channel element such that an identical longitudinal open-sided groove forming a part of said seat for at least one refractory insert channel element is formed in each of said at least two identical frame parts of metal wherein the method comprises a fourth providing step for providing a fastener for fastening the taphole assembly to a metallurgical furnace, and releasable fastening the fastener to said at least two identical frame parts of metal so that the fastener at least partly surrounds said at least two identical frame parts of metal.

2. The method according to claim 1, wherein the method comprises providing the taphole assembly with cooling channels for circulation of a cooling medium in the frame section of metal.

3. The method according to claim 1, wherein the method comprises providing in the first providing step a frame section of metal comprising two identical frame parts of metal, and providing each frame part of metal with an identical longitudinal open-sided groove in the form of a straight half-cylindrical groove.

4. The method according to claim 1, wherein the method comprises providing in the first providing step a frame section of metal comprises four identical frame parts of metal, and providing each frame part of metal with a longitudinal groove in the form of a straight semi-cylindrical groove.

5. The method according to claim 3, wherein the method comprises providing in the second providing step at least one refractory insert channel element that cylindrical and that has a concentric channel for melt.

6. The method according to claim 1, wherein the method comprises providing in the first providing step a frame section of metal that is at least partly made of copper and/or copper alloy.

7. A taphole assembly for arranging in a taphole assembly opening extending through a shell and a refractory lining of a metallurgical furnace and for leading melt from the inside of the metallurgical furnace to the outside of the metallurgical furnace, wherein the taphole assembly comprises a frame section of metal to be arranged in a taphole assembly opening extending through a shell and a refractory lining of a metallurgical furnace, at least one refractory insert channel element-arranged in a seat of the frame section of metal and having a channel for melt, wherein the frame section of metal comprises at least two identical frame parts of metal, wherein a separate face plate of metal is releasable fastened to said at least two identical frame parts of metal at an end face of the taphole assembly, and wherein said at least two identical frame parts of metal are connected such that a connection face between said at least two identical frame parts of metal forms the seat for the refractory insert channel element such that an identical longitudinal open-sided groove forming a part of said seat for at least one refractory insert channel element is formed in each of said at least two identical frame parts of metal; wherein the taphole assembly further comprises a fastener for fastening the taphole assembly to the metallurgical furnace, the fastener being releasable fastened to said at least two identical frame parts of metal, and the fastener at least partly surrounding said at least two identical frame parts of metal.

8. The taphole assembly according to claim 7, wherein the taphole assembly further comprises cooling channels for circulation of a cooling medium in the frame section of metal.

9. The taphole assembly according to claim 7, wherein the frame section of metal comprises two identical frame parts of metal.

10. The taphole assembly according to claim 7, wherein each frame part of metal comprising an identical longitudinal open-sided groove in the form of a straight half-cylindrical groove and wherein at least one refractory insert channel element being cylindrical and having concentric channel for melt.

11. The taphole assembly according to claim 8, wherein the frame section of metal comprises four identical frame parts of metal.

12. The taphole assembly according to claim 10, wherein each frame part of metal comprising a longitudinal groove in the form of a straight semi-cylindrical groove and wherein at least one refractory insert channel element being cylindrical and having a concentric channel for melt.

13. The taphole assembly according to claim 7, wherein the frame section of metal being at least partly made of copper and/or copper alloy.

14. Metallurgical furnace, wherein the metallurgical furnace comprises a shell and a refractory lining, a taphole assembly opening extending through the shell and the refractory lining of a metallurgical furnace, and a taphole assembly for leading melt from the inside of the metallurgical furnace to the outside of the metallurgical furnace arranged in the taphole assembly opening, wherein the taphole assembly comprises a frame section of metal and at least one refractory insert channel element arranged in a seat of the frame section of metal and having a channel for melt, wherein a separate face plate of metal is releasable fastened to at least two identical frame parts of metal at an end face of the taphole assembly, wherein the frame section of metal comprises said at least two identical frame parts of metal, and by said at least two identical frame parts of metal are connected such that a connection face between said at least two identical frame parts of metal forms the seat for the refractory insert channel element such that an identical longitudinal open-sided groove forming a part of said seat for at least on refractory insert channel element is formed in each of said at least two identical frame parts of metal; wherein the metallurgical furnace further comprises a fastener for fastening the taphole assembly to the metallurgical furnace, the fastener being releasable fastened to said at least two identical frame parts of metal, and the fastener at least partly surrounding said at least two identical frame parts of metal.

15. The metallurgical furnace according to claim 14, wherein it further includes cooling channels for circulation of a cooling medium in the frame section of metal.

16. The metallurgical furnace according to claim 14, wherein the frame section of metal comprises two identical frame parts of metal.

17. The metallurgical furnace according to claim 16, wherein each frame part comprising an identical longitudinal open-sided groove in the form of a straight half-cylindrical groove and wherein at least one refractory insert channel element being cylindrical.

18. The metallurgical furnace according to claim 14, wherein the frame section of metal comprises four identical frame parts of metal.

19. The metallurgical furnace according to claim 18, wherein each frame part comprising a longitudinal groove in the form of a straight semi-cylindrical groove and wherein at least one refractory insert channel element being cylindrical.

20. The metallurgical furnace according to claim 14, wherein the frame section of metal being at least partly made of copper and/or copper alloy.

* * * * *